US005165787A

United States Patent [19]

Holzhacker

[11] Patent Number: 5,165,787

[45] Date of Patent: Nov. 24, 1992

[54] LAMP SHADE HAVING ROTATABLE LIGHT DEFLECTORS

[76] Inventor: Albert Holzhacker, Rua Joao Felipe Silva 43, Sto. Amaro, Sao Paulo, Brazil, 04638

[21] Appl. No.: 789,955

[22] Filed: Nov. 12, 1991

[51] Int. Cl.[5] ..... F21V 11/00

[52] U.S. Cl. ..... 362/351; 362/354; 362/360; 362/321; 362/324; 362/283; 362/290

[58] Field of Search ..... 362/351, 354, 360, 319, 362/321, 322, 324, 325, 277, 279, 281, 282, 283, 290

[56] References Cited

U.S. PATENT DOCUMENTS

| | | | |
|---|---|---|---|
| 77,115 | 4/1868 | Smith | 362/360 |
| 149,386 | 4/1874 | Fox . | |
| 188,700 | 3/1877 | Von Otter . | |
| 479,207 | 7/1892 | Edmond . | |
| 881,597 | 3/1908 | Lord . | |
| 1,518,012 | 12/1924 | Smith . | |
| 1,725,117 | 8/1928 | Walthers . | |
| 1,740,603 | 12/1929 | Kellert . | |
| 1,868,776 | 7/1932 | Tate . | |
| 2,437,825 | 3/1948 | Kohn | 362/325 |
| 2,670,431 | 2/1954 | Bullock . | |
| 2,997,576 | 8/1961 | Heitshu . | |
| 3,049,962 | 8/1962 | Denecke . | |
| 3,088,025 | 4/1963 | Deaton . | |
| 3,115,310 | 12/1963 | Hofman . | |
| 3,456,101 | 7/1969 | Rentschler . | |
| 3,774,024 | 11/1973 | Deaton . | |
| 4,314,320 | 2/1982 | Wolar | 362/342 |
| 4,499,529 | 2/1985 | Figueroa | 362/283 |
| 4,800,473 | 1/1989 | Tremblay | 362/217 |

FOREIGN PATENT DOCUMENTS

| | | | |
|---|---|---|---|
| 697355 | 10/1930 | France | 362/279 |

*Primary Examiner*—Ira S. Lazarus
*Assistant Examiner*—Sue Hagarman
*Attorney, Agent, or Firm*—Cushman, Darby & Cushman

[57] ABSTRACT

A lamp shade including a plurality of light deflecting elements. The light deflecting elements are rotatably mounted so as to be independently rotated with respect to the frame and one another. In one embodiment the light deflecting elements are mounted end to end to allow vertical variation in light intensity and direction. In another embodiment the light deflecting elements are both horizontally and vertically disposed to increase versatility in both appearance and lighting effect. Thus, the lamp shade which advantageously allows the light to be directed in accordance with the particular area in which the light fixture is placed, both to shield the user's eyes and to direct light where it is most needed. At the same time, because the light emanating from the light source can be efficiently used in that it can be directed to the areas in which it is desired or required in an amount determined by the user, a lesser wattage light source can be effectively used to light the area in the vicinity of the light source to the same extent as a higher wattage light source in a conventional shade.

21 Claims, 3 Drawing Sheets

LAMP SHADE HAVING ROTATABLE LIGHT DEFLECTORS

BACKGROUND OF THE INVENTION

1. Field of the Invention

The present invention relates to illumination devices and, in particular, to a lamp which has an adjustable shade or shield formed from a plurality of interconnected light deflectors.

2. Description of the Related Art

Most lighting fixtures whether floor lamps, wall mounted light fixtures or ceiling fixtures, have diffusers or shades to prevent the light emitted from the light source from shining in the user's eyes, to direct the light towards the object or area to be lit, and/or for aesthetic purposes. For example, floor and table lights typically have a shade which is semi-cylindrical or is conical to direct the light from the light source downwardly onto the surface of the desk or table, or towards a reading chair or the like.

A significant deficiency of conventional lamp shades and deflectors is the intensity of light directed in a particular direction can not be altered, unless the entire shade is moved. For example, the light emitted from desk lamps is directed almost entirely downwardly. Accordingly, additional lamps and/or ceiling lights are typically required to fully illuminate a room. Likewise many wall mounted lamps have shades which direct substantially all of the light against or along the wall whereby the surrounding area will be only dimly lit. Thus, ceiling lights or a great number of fixtures must be provided for total lighting.

Further, because light emanating from light source is typically confined to a particular area by lamp shades, a high light intensity is required if there is to be any peripheral lighting. Thus, a relatively high wattage light source is required for shaded lamps to achieve a given level of peripheral lighting.

Efforts have been made heretofore to produce devices for controlling the amount and direction of light emitted from a light source. For example, 3-way light bulbs and dimmer switches are commonly used to offer the user a variety of light intensities. Such devices, however, do not allow directional intensity variation.

Others have developed shades which allow the user to vary the amount of light allowed to pass therethrough. Typically, such shades are in the form of a plurality of louvers disposed either in a single plane in front of a spot or track light or in a cylinder surrounding the light source.

For example, U.S. Pat. No. 4,800,473 to Tremblay shows a lamp having a series of louvers that are lengthwise pivotable between an opened and a closed position. The louvers are simultaneously adjusted through the use of an annular gear mounted on the lamp base.

U.S. Pat. No. 2,437,825 to Kohn shows a lamp shade with a plurality of pivoting blades. The movement of a control ring causes rotation of the blades from an opened position to a closed position. Again, the blades are interconnected so that all blades are adjusted simultaneously.

U.S. Pat. Nos. 188,700 to Von Otter and U.S. Pat. No. 2,670,431 to Bullock also relate to lamp shades that have adjustable louvers that are simultaneously adjusted.

A problem common to each of the above-identified lamps is that the louvers cannot be independently adjusted to allow a higher degree of flexibility in directing the illuminating light.

Because the light deflecting elements of the above-noted structures can only be altered in unison, the resulting lighting effect is typically an all or nothing effect. The light is either allowed to pass through the shade or it is not and the user does not have the opportunity to adjust lighting in accordance with the particular environment in which the light fixture is used. Even if intensity passing through the shade can be gradually increased or decreased, no directional control is possible and, therefore, the light emitted can not be effectively utilized to maximize energy efficiency.

SUMMARY OF THE INVENTION

It is an object of the present invention to provide a lamp that has adjustable light deflectors mounted independently so the illuminating light may be directed in any manner desired.

It is a further object to reduce the required wattage of light source and thus the amount of energy required to light a room by more efficiently directing the available light to those areas in which it is needed.

The foregoing and other objects of the invention are realized by providing a lamp shade including a support frame; a plurality of light deflecting elements, each light deflecting element having a first end and a second end spaced from the first end; and a mounting device for rotatably mounting at least one of the ends of each of the light deflecting elements to the support frame so that at least some of the light deflecting elements can be independently rotated relative to the support frame and the other of the light deflecting elements.

Thus, the present invention provides a light deflector system which advantageously allows the light to be directed in accordance with the particular area in which the light fixture is placed, both to shield the user's eyes and to direct light where it is most needed. At the same time, because the light emanating from the light source can be efficiently used in that it can be directed to the areas in which it is desired or required in an amount determined by the user, a lesser wattage light source can be effectively used to light the area in the vicinity of the light source to the same extent as a higher wattage light source in a conventional shade. Thus, the inventive light deflecting system advantageously saves energy by most efficiently directing the light emanating from the light source.

Other objects, features and characteristics of the present invention, as well as the methods of operation and functions of the related elements of the structure, and the combination of parts and economies of manufacture, will become more apparent upon consideration of the following detailed description and the appended claims with reference to the accompanying drawings all of which form a part of this specification, wherein like reference numerals designate corresponding parts in the various figures.

DETAILED DESCRIPTION OF THE PRESENTLY PREFERRED EXEMPLARY EMBODIMENTS

Figure 1:
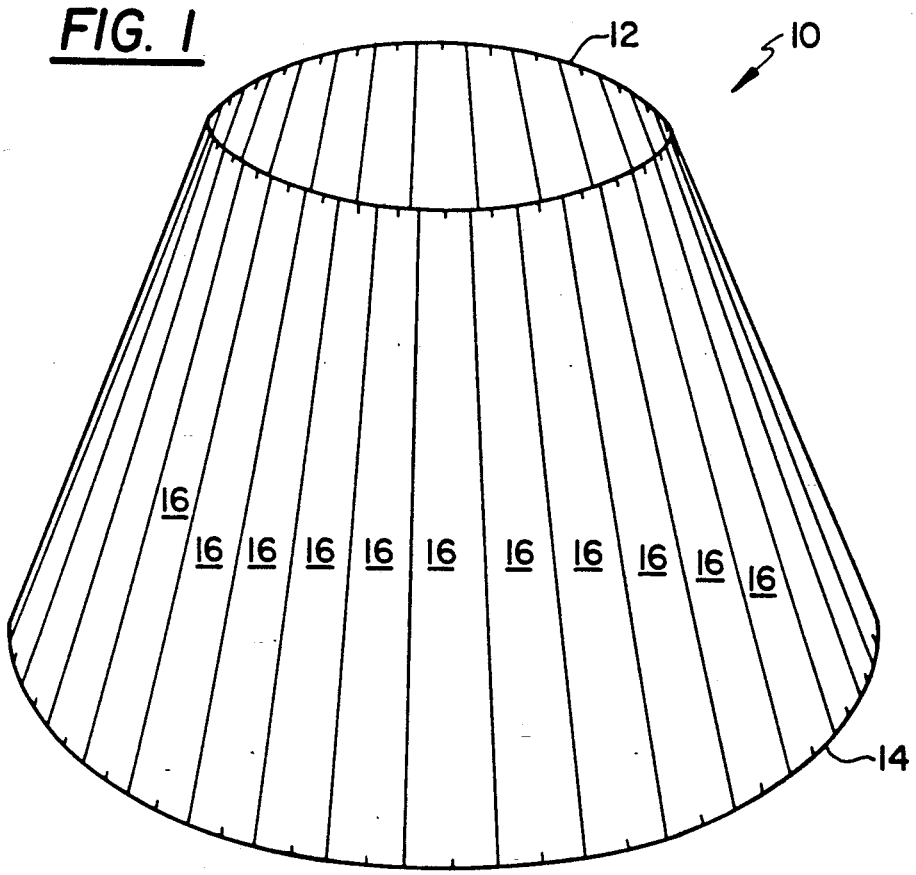
FIG. 1 is a perspective view of a lamp shade in accordance with one embodiment of the present invention.

A lamp shade or shield formed in way of example in FIG. 1. The lamp shade 10 includes a support or frame 12,14 and a plurality of light deflecting elements 16 which are coupled to the frame. At least some of the light deflecting elements 16 are mounted so that they can be rotated about an axis passing therethrough.

In the embodiment of FIG. 1, the frame comprises two ring shaped, horizontally disposed support members 12, 14 and the light deflecting elements 16 are coupled at each longitudinal end to one of the support members. The deflectors 16 can be directly coupled to each of the support members 12,14 or the frame can include spoke elements like those shown at 18 which extend between spaced portions of the support and the deflectors 16 can be rotatably mounted to the spokes in any suitable manner. Thus, the interconnection of the deflectors 16 to the support members 12,14 is only schematically shown and illustrative coupling elements are discussed more fully below.

In the illustrated embodiment, the lower support member 14 has a greater diameter than the upper support member 12. However, the support members could be of equal diameter or the upper support member 12 can have a greater diameter than the lower support member 14. Also, the frame, whether defined by one or more support members, could be in the form of an arc, a plane or a spiral, depending on the type of lamp, the lighting desired, and stylistic preferences of the user.

Figure 4:
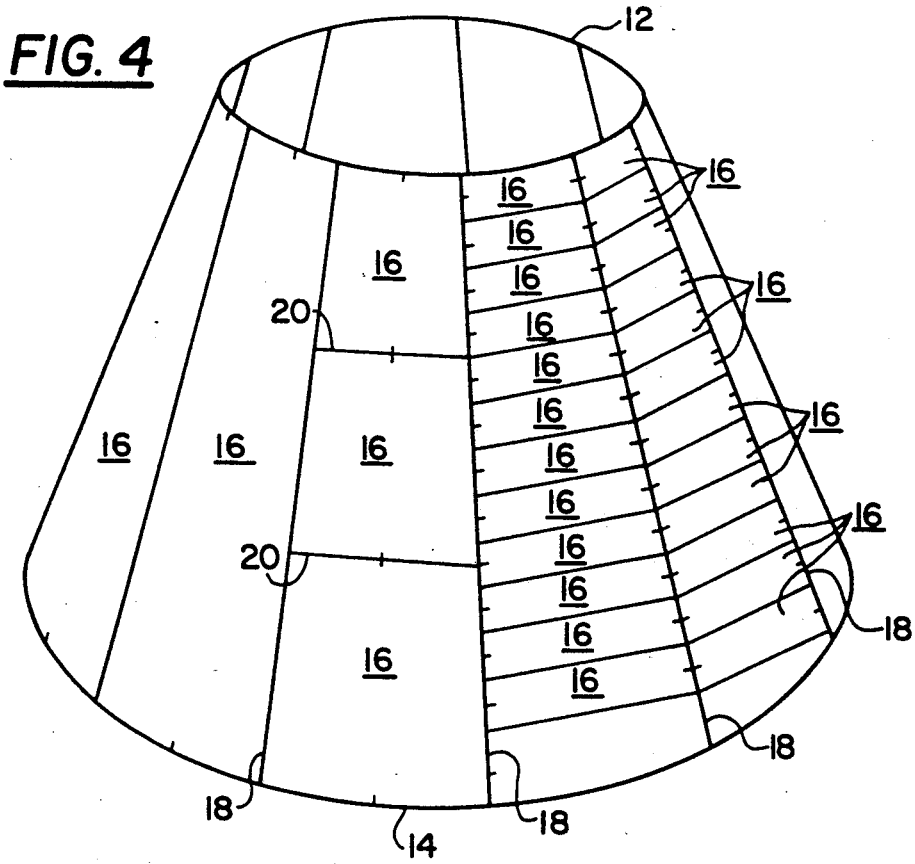
FIG. 4 is a perspective view of a lamp shade in accordance with yet another embodiment of the invention which has light deflecting elements in both horizontal and vertical orientations.

Also, the deflectors 16 need not all be disposed generally vertically as shown in FIG. 1. Indeed, the deflectors 16 may be disposed horizontally or a combination of horizontal and vertical deflectors 16 could be provided, as shown in FIG. 4, to maximize lighting versatility. When horizontal deflectors 16 are provided, the frame necessarily includes at least some vertical support members or spokes 18. The light deflecting elements 16 are then rotatably supported between two adjacent spoke elements 18.

Figure 3:
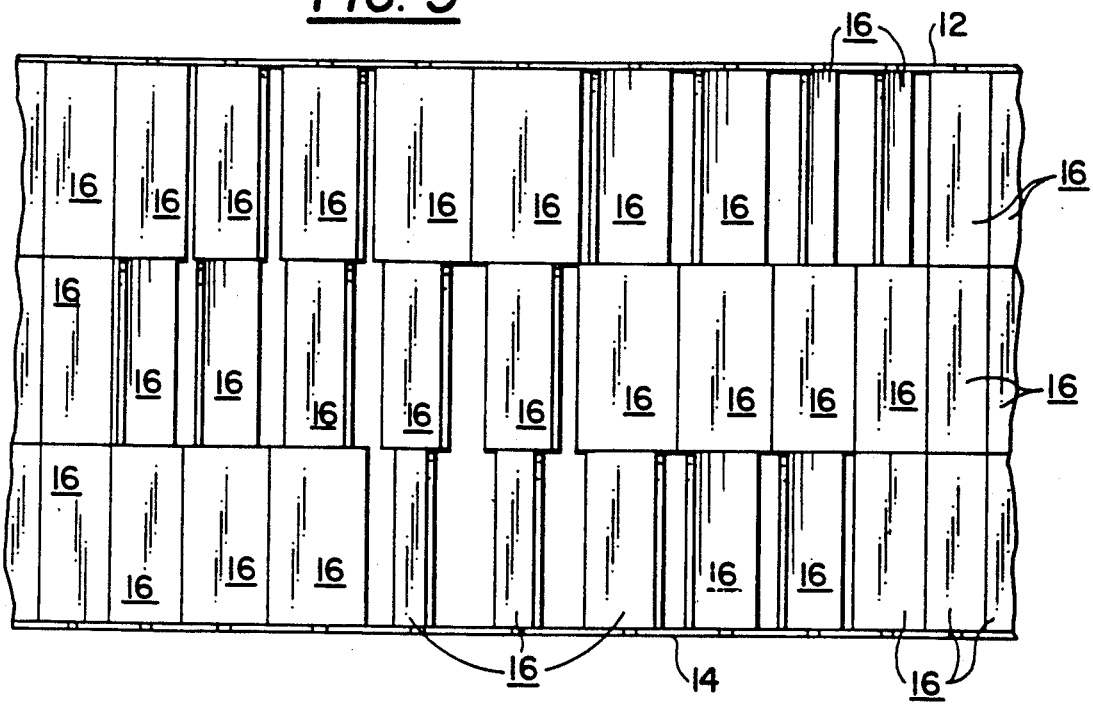
FIG. 3 is an enlarged partial elevational view of a lamp shade in accordance with another embodiment of the invention which has several tiers of light deflecting elements.

As a further alternative, the light deflecting elements 16 may be linearly interconnected, end to end or edge to edge so that the lamp shade 10 comprises a plurality of vertically adjacent deflectors 16. By way of example, FIG. 3 illustrates three tiers of vertically oriented light deflecting elements in combination with a plurality of horizontally disposed light deflecting elements 16. Each of the light deflecting elements 16 is preferably independently rotatable. Thus, as illustrated, the user can easily independently adjust the light deflecting elements 16 to various angles to vary the light intensity and direction along the height and width of the lamp shade 10 to accommodate the particular environment which the light fixture is to be used. Such assemblies of interconnected deflecting elements 16 may extend along a portion of the height and/or width of the shade or may extend all the way between the upper and lower peripheral supports 12,14. As noted above, the frame may include horizontal spokes 20 and/or vertical spokes 18 to which the adjacent deflectors 16 are directly or indirectly coupled, or the deflectors 16 may be directly coupled to one another. As is apparent from FIG. 4, any combination of sizes and orientations of light deflecting elements 16 may be used in a single lamp shade 10.

The light deflecting elements 16 may be mounted to the frame in any manner which allows them to be independently rotatable relative to the frame and each other from a position which allows light to pass without obstruction or deflection to a position which allows no light to freely pass and any point therebetween. Thus, as noted above, spoke elements 18 may extend between vertically or horizontally spaced frame or support members 12,14 and the deflectors 16 may be directly coupled thereto so as to be rotatable thereabout to present a face of varying inclination and functional width.

In the alternative, straight pegs and peg receiving sockets can be provided on the peripheral edges of the deflectors 16 and/or on the support frame 12,14 to allow rotation or pivoting of the deflectors 16 about an axis passing therethrough.

Figure 5:
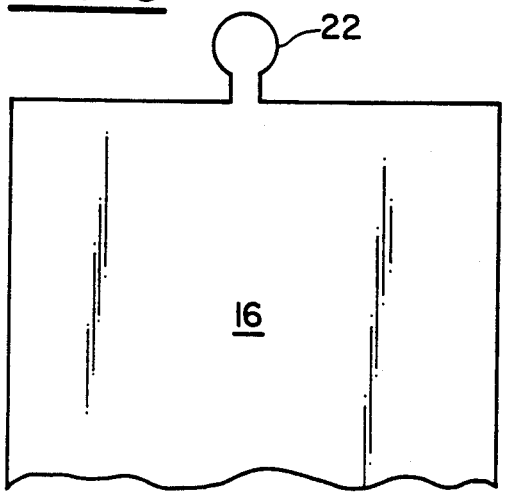
FIG. 5 is a view, partially broken away, of a light deflector having a ball and socket-type connector.

As an alternative, as shown in FIG. 5, a ball and socket connection can be provided for mounting a light deflecting element 16 to a support member 12,14. In the illustrated embodiment, a ball element 22 is coupled to a peripheral edge of the deflector 16 and is received in a correspondingly sized and shaped socket (not shown) coupled to the support frame of the shade. The connectors may, of course, be reversed so that the socket is coupled to the deflector 16. Further, in the event a plurality of light deflecting elements 16 are interconnected end to end or edge to edge, the light deflecting elements 16 may be provided with a ball 22 at one end and a socket at the other end.

A ball and socket connection will allow rotational movement of the deflector 16 if the deflector 16 is coupled to and extends between two support members 12,14 of the frame. That rotational motion is about an axis of rotation extending between those two connections. If the deflector 16 is coupled to the frame at only one end thereof, such a ball and socket connection allows the light deflecting element 16 to be moved with three degrees of freedom and thus it can be pivoted relative to the frame in addition to rotated about its axis.

Figure 6:
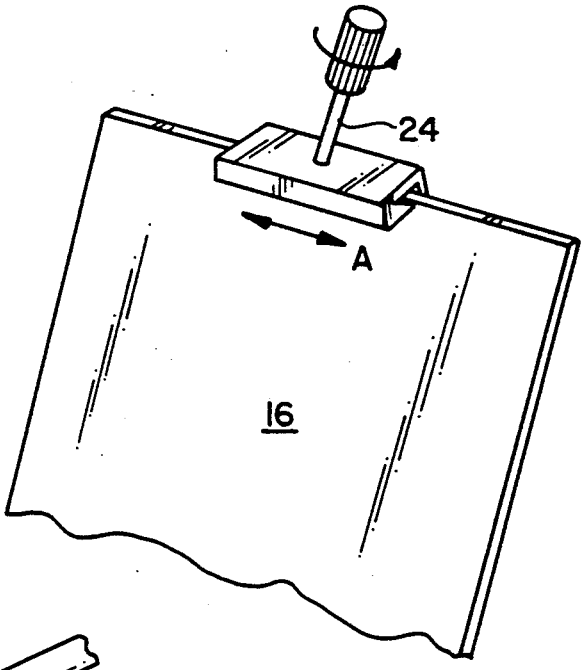
FIG. 6 is a view, partially broken away, of a light deflector having a connector defining two degrees of freedom.

As yet a further alternative, a connector of the type shown in FIG. 6, which allows the light deflecting element 16 to move with two degrees of freedom, can be provided. The embodiment of FIG. 6 allows the light deflecting element 16 to pivot or rotate about the axis of the rod 24 and allows the light deflecting element 16 to be slid in the direction of arrow A. The connector of FIG. 6 can be connected to the frame of the lamp shade in any suitable manner. For example, rod 24 can extend through a bore defined through support member 12 whereby rotation of rod 24 relative to the support member 12 is possible.

Figure 7:
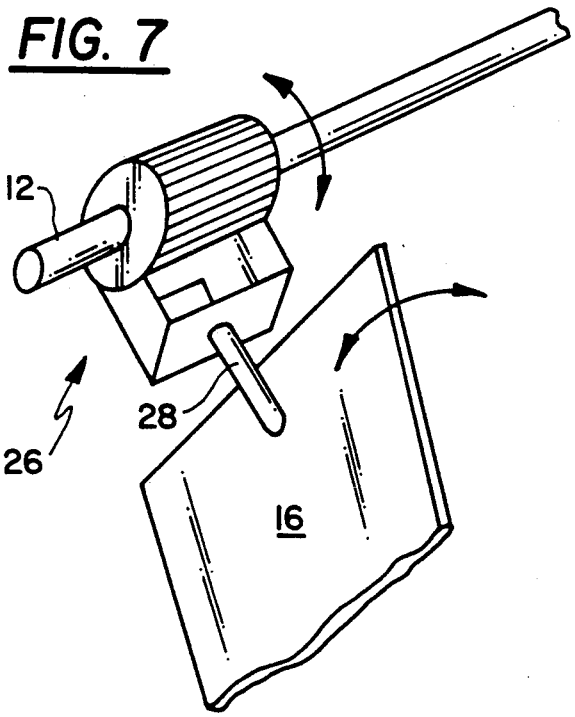
FIG. 7 is a view, partially broken away, of another light deflector having a connector defining two degrees of freedom.

As yet a further alternative a connector 26 of the type illustrated in FIG. 7 can be provided. That connector is similar in many respects to that of FIG. 6 and element 16 may be slidably coupled to the connector 26 in a like manner. The connector 26 of FIG. 7 is characterized in that it is pivotally connected to the support, for example support member 12, and the light defecting element 16 is rotatably coupled thereto. The coupling to the frame can be sufficiently snug that the connector 26 will remain in an orientation in which it has been placed or a set screw can be provided to lock the connector in a selected position. Likewise, the light deflecting element 16 can be retained in a particular position in any known manner. For example, the rod 28 can be threaded and be threadably engaged with connector 26 to thereby hold a selected rotatary position.

Light deflecting elements 16 can be made of any of a number of different materials depending on the type of lamp with which it is used, the area to be lit, and the type and style of lighting desired. Thus, the light deflecting elements 16 can be made of plastic, a rigidified or framed fabric or other natural or man-made sheet of material, metal and/or glass. The materials chosen for the light deflecting element 16 can also vary in transparency, reflectivity, and color. Thus, the light deflecting elements can be made of a material that is light reflective., such as metal, whether or not colored, or a mirrored material. Alternatively, the light deflecting elements can be made of a translucent material to thereby allow only some light to pass therethrough while reflecting the rest. As yet a further alternative, the light deflecting elements can have two different surfaces such as a mirror or metalized surface on one side and a non-reflective material or fabric on the other side. The variety of materials for the light deflecting elements and the various combinations are limited only by the manufacturer's imagination.

Figure 2:
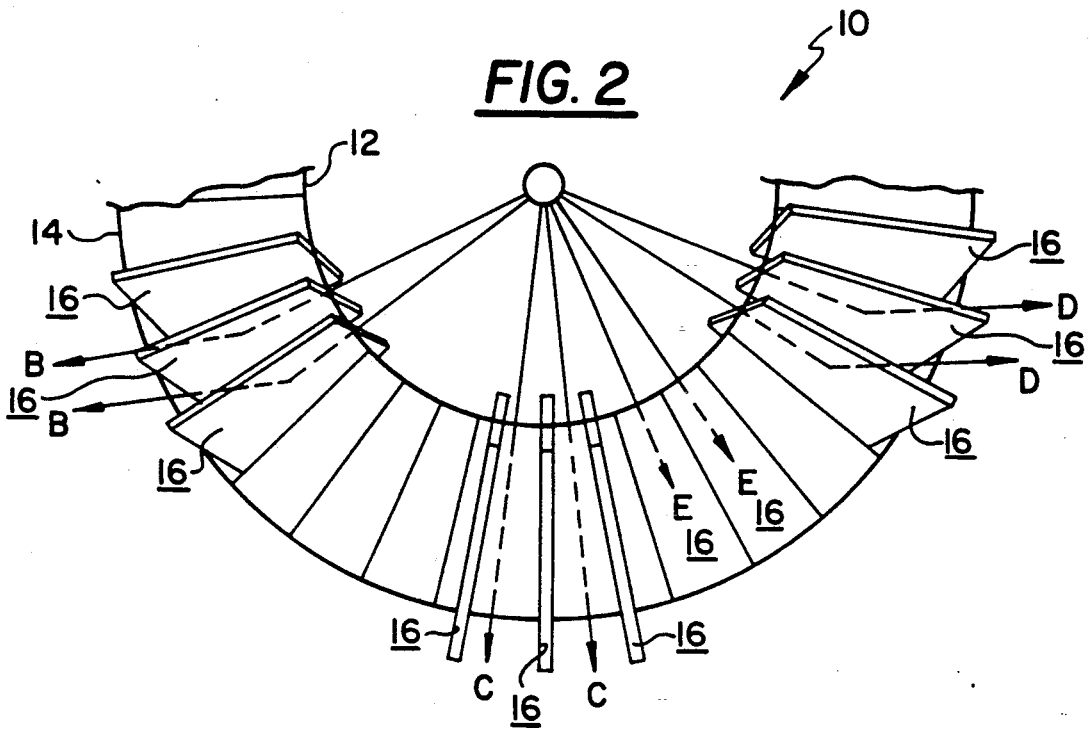
FIG. 2 is a top view of the lamp shade of FIG. 1 with the light deflecting elements in various angled positions to control the distribution of light.

FIG. 2 shows the lamp shade 10 with the light deflecting elements 16 rotated in various directions. As shown, depending on the angle of the light deflecting element 16, the light emitting from the light source can be allowed to pass straight through the lamp shade 10 (arrow C), to be deflected to pass in a particular direction (arrows B and D), or to be partially or wholly obstructed (arrow E).

While the invention has been described in connection with what is presently considered to be the most practical and preferred embodiments, it is to be understood that the invention is not limited to the disclosed embodiments, but, on the contrary, is intended to cover various modifications and equivalent arrangements included within the spirit and scope of the appended claims.

What is claimed is:

1. A lamp shade comprising:

(a) a support frame;

(b) a plurality of light deflecting elements, each said light deflecting means having a first end and a second end spaced from said first end; and (c) mounting means for mounting said light deflecting elements to said support frame so that at least some of said light deflecting elements are movable, independently, relative to the support frame and other light deflecting elements, at least some of said light deflecting elements being coupled end to end, with a second end of one light deflecting element coupled to a first end of a next adjacent light deflecting element, to define light deflecting assemblies, the axes of the light deflecting elements in each said light deflecting assembly being defined in a common plane, said common plane being disposed at an angle of greater than zero with respect to a horizontal plane of said support frame.

2. A lamp shade as recited in claim 1, wherein said support frame comprises an upper support element and a lower support element, at least some of said light deflecting elements being mounted at said first end thereof to said upper support element and at said second end thereof to said lower support element.

3. A lamp shade as recited in claim 2, wherein said upper support element is an upper ring member and said lower support member is a lower ring member.

4. A lamp shade as recited in claim 3, wherein said lower ring member has a diameter greater than said upper ring member.

5. A lamp shade as recited in claim 1, wherein at least some of said light deflecting assemblies are disposed at an angle or greater than zero with respect to a horizontal plane.

6. A lamp shade as recited in claim 1, wherein said light deflecting in said light deflection assemblies are rotatable independently of each other.

7. A lamp shade as recited in claim 1, wherein at least some of said light deflecting elements are mounted horizontally.

8. A lamp shade as recited in claim 1, wherein at least some of said light deflecting elements are pivotable relative to said support frame.

9. A lamp shade as recited in claim 1, wherein said deflecting elements are free from overlap.

10. A lamp shade comprising:

(a) a support frame;

(b) a plurality of light deflecting elements, each said light deflecting elements having a first end and a second end spaced from said first end; and (c) mounting means for mounting said light deflecting elements to said support frame so that at least some of said light deflecting elements are movable, independently, relative to the support frame comprising a plurality of vertically spaced apart, interconnected support tiers, a plurality of light deflecting elements being rotatably mounted to each said support tier.

11. A lamp shade comprising:

(a) a support frame;

(b) a plurality of light deflecting elements, each said light deflecting element having a first end, a second end spaced from said first end, and an axis between said ends; and (c) mounting means for mounting said light deflecting elements to said support frame so that at least some of said light deflecting elements are movable, independently, relative to the support frame and other light deflecting elements, said mounting means allowing the light deflecting elements to be moved with at least two degrees of freedom.

12. A lamp shade as recited in claim 11, wherein at least some of said light deflecting elements mounted to said support frame so as to be in vertically spaced relation with respect to one another.

13. A lamp shade as recited in claim 12, wherein said mounting means allows the light deflecting elements to be moved with three degrees of freedom.

14. A lamp shade as recited in claim 13, wherein said mounting means comprises a ball and socket connection.

15. A lamp shade as recited in claim 11, wherein said support frame comprises a ring member, at least some of said light deflecting elements being mounted to said ring member.

16. A lamp shade as recited in claim 15, wherein at least some of said light deflecting elements depend downwardly from said support frame.

17. A lamp shade as recited in claim 15, wherein at least some of said light deflecting elements are light reflective.

18. A lamp shade as recited in claim 15, wherein at least some of said light deflecting elements are translucent.

19. A lamp shade comprising:

(a) a support frame;

(b) a plurality of light deflecting elements, each said light deflecting element having a first end, a second end spaced from said first end, and an axis extending between said ends; and (c) mounting means for mounting said light deflecting elements to said support frame so that at least some of said light deflecting elements are movable, independently, relative to the support frame and other light deflecting elements at least some of said light deflecting elements being mounted horizontally and at least some of said light deflecting elements being mounted vertically, the axis of said horizontally mounted light deflecting elements and of said vertically mounted light deflecting elements together defining a single, smoothly contoured surface.

20. A lamp shade as recited in claim 19, wherein said mounting means comprises a pin and socket therefor.

21. A lamp shade as in claim 19, wherein said deflecting elements are free from overlap.

* * * * *